US005666679A

United States Patent [19]

Ruddy

[11] Patent Number: 5,666,679

[45] Date of Patent: Sep. 16, 1997

[54] ROUND BLANKET STRUCTURE AND METHOD FOR MAKING THE SAME

[76] Inventor: Gaila O. Ruddy, 5 River Rd., Ste. 326, Wilton, Conn. 06897

[21] Appl. No.: 507,587

[22] Filed: Jul. 26, 1995

[51] Int. Cl.[6] ..... A47G 9/02

[52] U.S. Cl. ..... 5/502; 5/485; 5/417; 112/440; 112/441

[58] Field of Search ..... 5/417, 420, 485, 5/486, 502, 902; 112/402, 440, 441, 475.04, 418

[56] References Cited

U.S. PATENT DOCUMENTS

| | | | |
|---|---|---|---|
| D. 325,489 | 4/1992 | Pratt | D6/608 |
| D. 339,710 | 9/1993 | Perna | D6/595 |
| 2,288,469 | 1/1942 | Lookholder . | |
| 2,731,997 | 1/1956 | Muth et al. . | |
| 2,803,845 | 8/1957 | Bradford . | |
| 4,005,499 | 2/1977 | Klein | 5/486 X |
| 4,337,812 | 7/1982 | Trinker | 150/11 |
| 4,703,528 | 11/1987 | Rolle | 5/502 X |
| 4,800,602 | 1/1989 | Luery | 5/417 |
| 4,860,395 | 8/1989 | Smith | 5/420 |
| 4,991,978 | 2/1991 | Ostrowski | 383/4 |
| 5,482,374 | 1/1996 | Buhyoff | 5/417 X |

*Primary Examiner*—Michael F. Trettel

[57] ABSTRACT

A large, round blanket structure includes at least two layers, each formed of semicircular sections diametrically joined and overlaid with seams crossed transversely. The layers are held together by stitching parallel to the the seams and stitching through a strip of binding material folded about the peripheral edge of the combined layers. The use of zig-zag stitches about 50% of the width of the binding overlapping at least one of said circular blanket layers provides a rugged construction and is consistent with a design giving the impression of rays of light (e.g., sun light) radiating from the center of the blanket. Preferably the method will utilize corner pieces, cut in making the semicircular sections, to make cone-shaped towels uniquely suitable for cleaning golf clubs and balls.

20 Claims, 5 Drawing Sheets

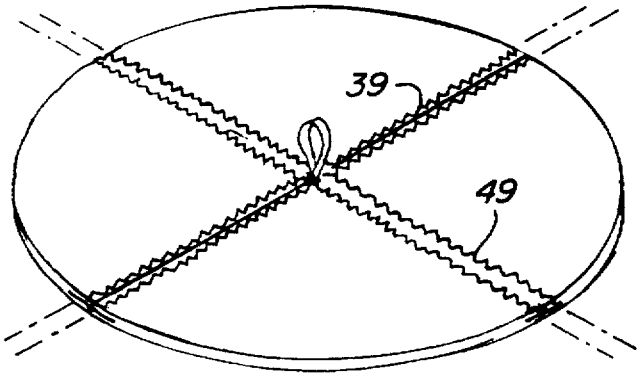
FIG. 5
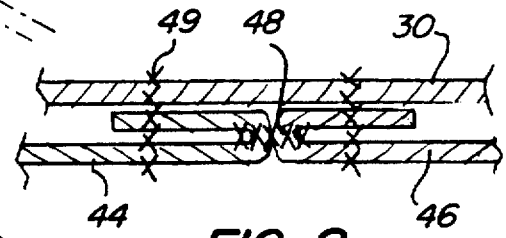
FIG. 8
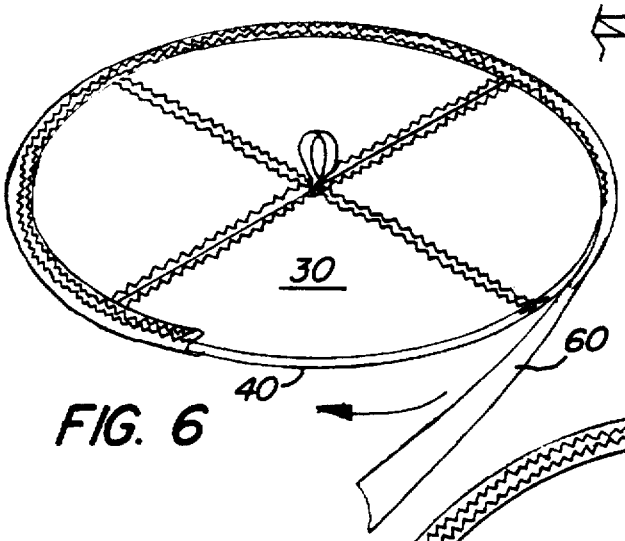
FIG. 6
FIG. 7
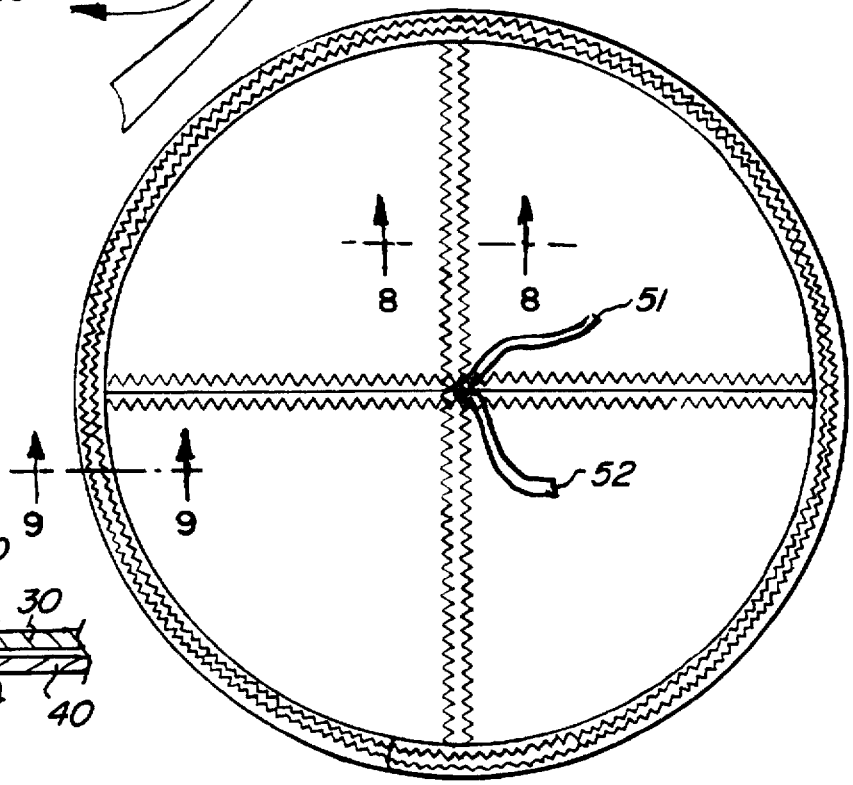
FIG. 9
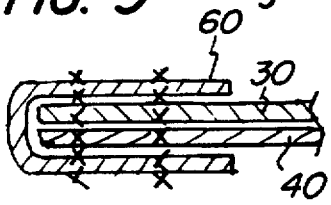

ROUND BLANKET STRUCTURE AND METHOD FOR MAKING THE SAME

TECHNICAL FIELD

The invention relates to improvements in blanket structures and methods of producing them, and in particular to round blankets assembled in a manner which enables large size, efficient construction, and increased utility of both the final construction and the materials used therefor.

The art has—for countless generations—provided an ever-growing assortment of blanket designs, structures and materials. There has been a desire and need to make blankets available for people of all sizes and virtually all occasions. From beds to beaches, and cribs to concerts—blankets have become indispensable.

Shapes from round to square—and most in between have been proposed. Round ones are often very appealing in appearance and practical in utility. However, weaving facilities typically produce suitable blanket fabrics in widths of less than six feet. This limits the size of round blankets or requires the presence of seams which can complicate the construction procedure, especially where there is a desire to employ different materials on opposite blanket sides.

BACKGROUND ART

The art generally has provided a number of designs for round blankets, but none has been devised that is large in dimension and yet provides a simple method of construction with the ability to employ more than one layer of material.

Among the blanket structures available to the art is that shown in U.S. Pat. No. 2,731,997 to Muth, et al. All of the structures appear to be relatively small in diameter and capable of being made from a single width of fabric. FIGS. 18 and 19 show a structure which functions as both a baby blanket and baby tote bag. A central circular layer is preferably water proof to enhance utility in this regard.

Another towel-into-a-bag combination is shown in U.S. Pat. No. 4,991,978 to Ostrowski. Here, a peripheral draw cord is provided to gather the round, apparently single-width of fabric, into a pouch-shaped bag.

Perna, Jr., in U.S. Pat. No. Des. 339,710, shows a design for a round beach towel which can be converted to a tote bag. And, Pratt shows a round beach towel in U.S. Pat. No. Des. 325,489. In each, the size appears limited so that only a single width of fabric is necessary and no seam is required.

U.S. Pat. No. 2,288,469 to Lookholder shows a round cover structure, of the kind used to protect automobile surfaces during repair, has centrally-positioned handle permits an effective manner for picking it up and hanging it with the dirty side up. In U.S. Pat. No. 2,803,845, Bradford shows a round beach towel with another hanger feature. No seams are shown, thus the size of both would appear to be limited to the available width of the fabric chosen.

In U.S. Pat. No. 4,337,812, Trinker shows a combined picnic bag and table cloth. A diametrical seam is provided on one of two fabric plies to enable the insertion of pockets between hem openings. Despite the seam, it does not appear that more than a single width of fabric is employed.

There is a need for a round blanket structure which enables the production of large, layered blankets in an efficient manner with a minimum of material wastage and the provision of products, unique in their own right from the scrap material trimmed during the preparation of the blankets.

DISCLOSURE OF THE INVENTION

It is an object of the invention to provide a blanket structure which enables the production of large, layered blankets.

It is another object of the invention to provide an efficient manner for making large round blanket structures.

It is another and still more specific object of the invention to provide a round blanket structure and products, unique in their own right from the scrap material trimmed during the preparation of the blankets.

It is still another and more specific object of the invention to provide a round blanket structure which enables the production of large, layered blankets in an efficient manner with minimal material wastage and the provision of products, unique in their own right, from the scrap material trimmed during the preparation of the blankets.

These and other objects are achieved by the present invention which provides both a blanket structure and a method for making it.

The blanket structure comprises: a first circular blanket layer having a round circumferential edge and a diameter passing through the center, said first circular blanket layer formed of two semicircular sections having at least one seam extending along or parallel to a first diameter of the blanket; a second circular blanket layer overlying the first circular blanket layer and having a round circumferential edge and a diameter passing through the center, said second circular blanket layer formed of two semicircular sections having at least one seam extending along or parallel to a second diameter of the blanket, said second diameter preferably being transverse to said first diameter; means for forming a handle secured near the center of at least one of said seams in one of said circular blanket layers; a strip of binding material sewn about and securing said first and second circular blanket layers into a round blanket having a unitary peripheral edge, said binding material preferably being stitched around said peripheral edge with a zig-zag stitch about 50% of the width of the binding overlapping at least one of said circular blanket layers; also, preferably including a pocket formed of at least one piece of fabric extending from one of said seams to the peripheral edge of one of said layers, wherein said one piece of fabric has a top edge substantially parallel to a line transverse to said diameter of said layer and a bottom edge covered by said binding along said circumference, said top edge being at least partially open and said bottom edge being substantially closed; and stitching parallel to, either directly adjacent or over, each of said seams in said first and second blanket layers said stitching extending through said first and second layers and holding said layers together, said stitching preferably comprising parallel lines of zig-zag stitches on either side of each of said seams, The round blanket structure can further comprise a third blanket layer positioned between said first blanket layer and said second blanket layer and/or can have one substantially water proof layer and/or a blanket layer comprising a nonwoven padding material. Preferably, at least one of the blanket layers comprises terry cloth.

According to the method of the invention, a round blanket is made by: providing at least four semicircular sections of material suitable for forming into a blanket; assembling a first circular blanket layer, having a round circumferential edge and a diameter passing through its center, by joining two of said semicircular sections along a seam extending along said diameter of said first circular blanket layer; assembling a second circular blanket layer, having a round circumferential edge and a diameter passing through its center, by joining two of said semicircular sections along a seam extending along said diameter of said second circular blanket; assembling said first and second blanket layers with the round peripheral edges of each substantially coextensive and with said first and second diameters being nonparallel; folding a strip of binding material to cover the coextensive peripheral edges of said first and second blanket layers; stitching said binding to secure it to said first and second circular blanket layers and to secure both of said blanket layers into a round blanket having a unitary peripheral edge; and stitching parallel to each of said seams in said first and second blanket layers said stitching holding said layers together.

In one variation of the invention, a conical towel structure is made by cutting at least one of said semicircular sections from terry cloth material to form for each semicircular section, two scrap portions having two straight edges that intersect at a square corner; cutting each of said scrap portions along a radius from said square corner to form a rounded cut edge; folding a strip of binding material to cover said rounded cut edge; inserting between said two straight edges, means for forming a handle; and joining said two straight edges by stitching them together along a seam to form an essentially cone-shaped towel. The towel structure is also unique.

BRIEF DESCRIPTION OF THE DRAWINGS

The invention will be better understood and its advantages will be better appreciated from the following detailed description, especially when read in light of the accompanying drawings, wherein:

FIG. 5 is a top perspective view of a partial assembly of the blanket structure;

FIG. 6 is a top perspective view of a partial assembly of the blanket structure, showing the attachment of a strip of binding material around the periphery of the blanket;

FIG. 7 is a top plan view of a fully-assembled blanket structure of the invention;

FIG. 8 is a cross-sectional view taken along line 8—8 in FIG. 7;

FIG. 9 is a cross-sectional view taken along line 9—9 in FIG. 7;

INDUSTRIAL APPLICABILITY

The improvements of the invention have application to the field of blankets, and particularly to assembly of large round blankets. The preferred form of the invention is a large, round blanket structure which includes at least two layers, each formed of semicircular sections diametrically joined and overlaid with seams crossed transversely. The layers are held together by stitching parallel to the seams and stitching through a strip of binding material folded about the peripheral edge of the combined layers. The use of zig-zag stitches on the binding provides a rugged construction and is consistent with a design giving the impression of rays of light (e.g., sun light) radiating from the center of the blanket. Preferably the method will utilize corner pieces, cut in making the semicircular sections, to make cone-shaped towels uniquely suitable for cleaning golf clubs and balls.

The description will refer to various parts by their usual orientation (e.g., front, back, top and bottom), however, this is done for ease of description and is not meant to limit the orientation of the devices in actual use. The term "fabric" as used in the description is meant to include any and all materials suitable for blanket construction, but preferably will be terry cloth for at least one layer, but can include nonwoven padding materials for interior layers and waterproofed materials for any of the layers as is desired. Also, many other woven and nonwoven materials of cotton, wool, synthetic fibers and the like can be employed.

Figure 1:
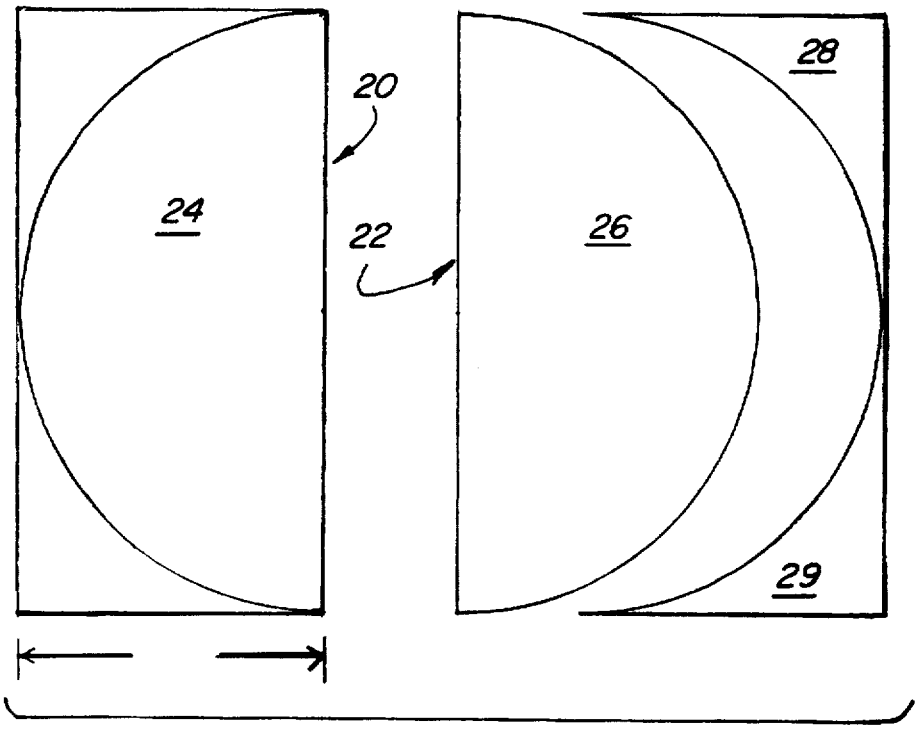
FIG. 1 is a top plan view of two pieces of material showing the detail of a preferred cutting pattern.

Reference to FIG. 1 shows a preferred pattern for cutting a suitable sheet material, preferably such as terry cloth (sheets 20 and 22), into semicircular pieces 24 and 26 for assembly into a single layer for forming a large, round blanket comprising either one layer as illustrated in FIGS. 10–13 or multiple layers as illustrated in FIGS. 1–9. In either case, it is an advantage of the invention that blankets having widths larger than (indeed, nearly twice the width) conventionally available fabric can be assembled. It is also an advantage of this cutting pattern that the scrap corners 28 and 29 can be recovered and assembled into a cone-shaped towel element, having particular utility for cleaning golf clubs and balls. Towels of this type and the method by which they are made are illustrated in FIGS. 14–19.

FIG. 1 shows a piece of material 20 having a width W which is laid out for cutting to form a semicircular section 24. The semicircular section 24 can be exactly one half of a circle or can have a small extension of material to provide an extra amount of material in the area of a seam which is made to join two like sections into one blanket layer. Typical commercial widths do not exceed 60 inches and this has been considered a limit on the size of the diameter of the blanket. However, by utilizing the procedures and structures of the invention, the width can be essentially double this dimension. Preferably, the blankets of the invention will have diameters of at least 36 inches, most preferably greater than 75 inches, e.g., 80 to 120 inches.

Figure 2:
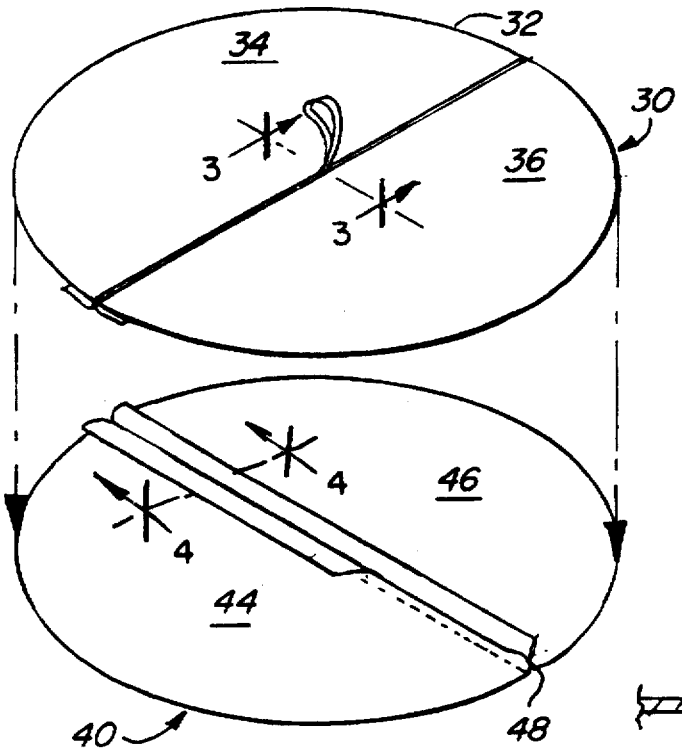
FIG. 2 is an exploded perspective view showing a preferred arrangement of two blanket layers.
Figure 3:
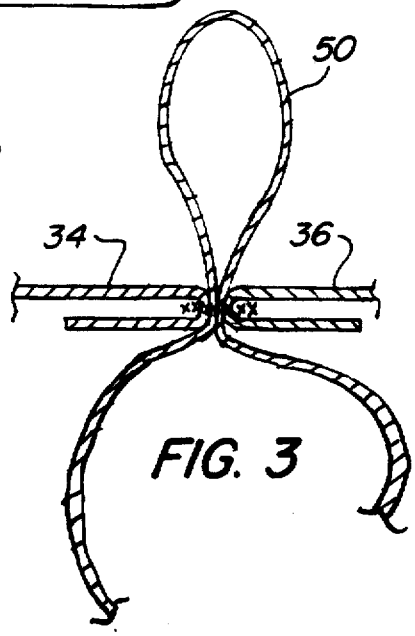
FIG. 3 is a cross-sectional view taken along line 3—3 in FIG. 2, showing the detail of one handle structure.
Figure 4:
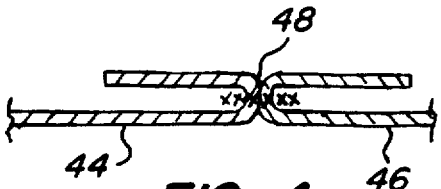
FIG. 4 is a cross-sectional view taken along line 4—4 in FIG. 2, showing the detail of a seam joining the two semicircular sections forming one blanket layer.
Figure 10:
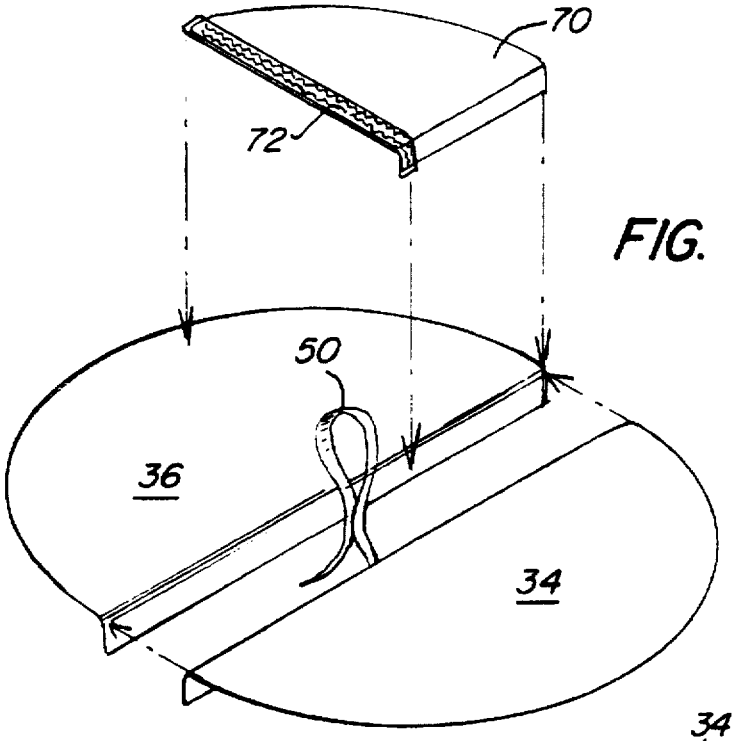
FIG. 10 is a top exploded perspective view showing the assembly of a single-layer blanket structure according to the invention.
Figure 13:
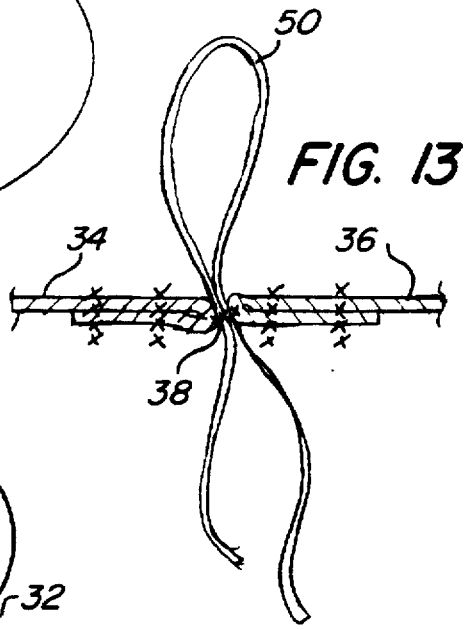
FIG. 13 is a cross-sectional view taken along line 13—13 in FIG. 12.
Figure 11:
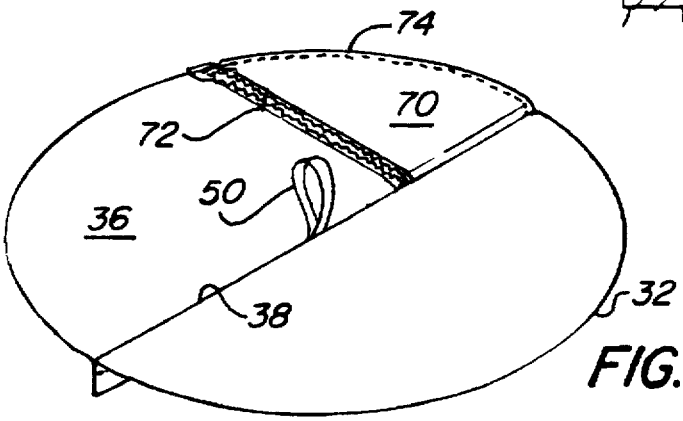
FIG. 11 is a top perspective view showing a succeeding step in the assembly illustrated in FIG. 10.

FIG. 2 shows two circular blanket layers being assembled into a multi layer blanket structure of the invention. A first circular blanket layer 30 having a round circumferential edge 32 and a diameter passing through the center. The first circular blanket layer 30 is formed of two semicircular sections 34 and 36 and has a seam 38 extending along the diameter of the blanket section. It is possible to form the seam 38 by overlapping layers and stitching parallel seams on opposite sides of the diameter, but the preferred seam arrangement is as shown in FIGS. 2–4.

A second circular blanket layer 40 is placed to overly the first layer 30, and also has a round circumferential edge (42) and a diameter passing through its center. The second circular blanket layer 40 is formed of two semicircular sections 44, 46 and has at least one seam 48 extending along or parallel to a second diameter of the blanket, preferably the same type of seam as in the other layer. The second diameter (and the second seam 48) being nonparallel to said first diameter (and the first seam 38). Preferably, the first and second seams are transverse to one another. The most preferred orientation of the layers is shown in FIG. 5. This permits the seam 38 to be followed when reinforcing stitching 39 is applied through both layers to hold them together. Similarly, this permits the seam 48 to be followed when reinforcing stitching 49 is applied through both layers to hold them together. The net effect is easy arrangement and straight stitching to form a strong, attractive blanket.

In the preferred form of the blanket, means for forming a handle 50 are secured near the center of at least one of the seams 38 or 48 in one of the circular blanket layers, 30 or 40. The means 50 can be made of either one or two pieces of fabric (ribbon, stitched, knitted, woven or of like construction). When formed of a single fabric piece as shown in FIG. 3, a loop can be formed and sewn into the seam as shown. When formed of two pieces, as illustrated in FIG. 7, both pieces can be sewn into the seam and the ends 51 and 52 extending outwardly from the seam can be tied together to form the handle.

A strip of binding material 60 is folded around the peripheral edge of the overlaid blanket layers 30 and 40 and is sewn thereto as shown in FIG. 6. The binding material 60 secures the first and second circular blanket layers into a round blanket having a unitary peripheral edge, as shown in final form in FIG. 7.

Figure 12:
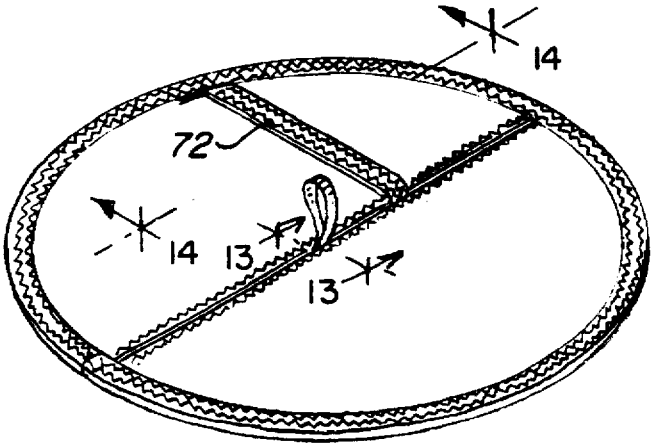
FIG. 12 is also a top perspective view showing the completed blanket shown in FIGS. 10 and 11.
Figure 14:
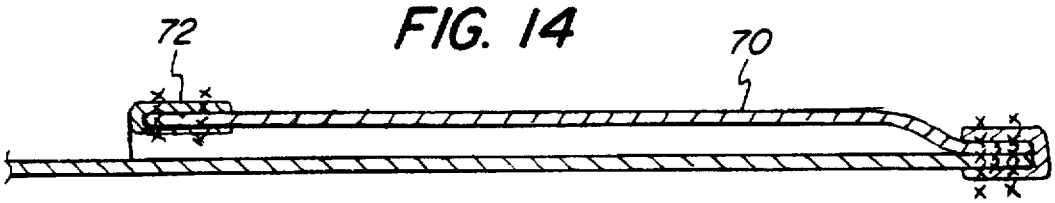
FIG. 14 is a cross-sectional view taken along line 14—14 in FIG. 12

The embodiment of FIGS. 10–13 is shown to further comprise a pocket 70 formed of at least one piece of fabric 72. The pocket is shown in these figures to be formed in a single thickness blanket, but the principles of construction apply to the formation of the pocket in one of two layers if desired. The pocket 70 is shown to extend from one of the seams (here, a single seam 38) to the peripheral edge 32. The piece of fabric 72 has a top edge substantially parallel to a line transverse to said diameter of said layer and a bottom edge coextensive with the periphery 32, and (as shown in FIG. 12) covered by the binding 60 along circumferential edge 32. Top edge is at least partially open and bottom edge 74 is substantially closed by the binding material 60. If desired, binding material can be added along the top edge 72, and stitching can be applied to enhance the strength and appearance.

In the embodiments shown in the figures, the binding material is stitched around said peripheral edge with a zig-zag stitch of 25 to 75% (say, about 50%) of the width of the binding overlapping at least one of said circular blanket layers. The use of large zig-zag stitches (e.g., ¼ to ¾ inch, preferably ½ inch, in height) on the binding provides a rugged construction and is consistent with a design giving the impression of rays of light (e.g., sun light) radiating from the center of the blanket. As will be described below, the detail of the stitching can best be seen in FIGS. 20 and 21.

Figure 15:
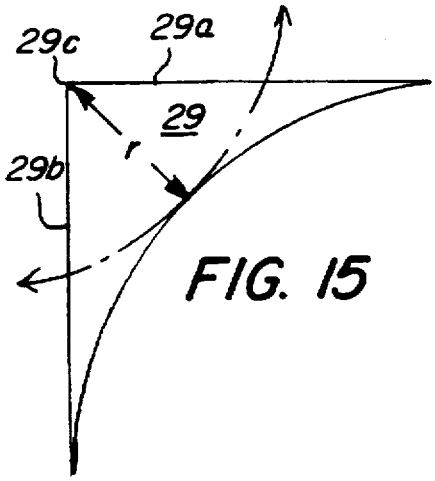
FIG. 15 is a top plan view of one corner scrap piece such as is shown cut in FIG. 1.
Figure 16:
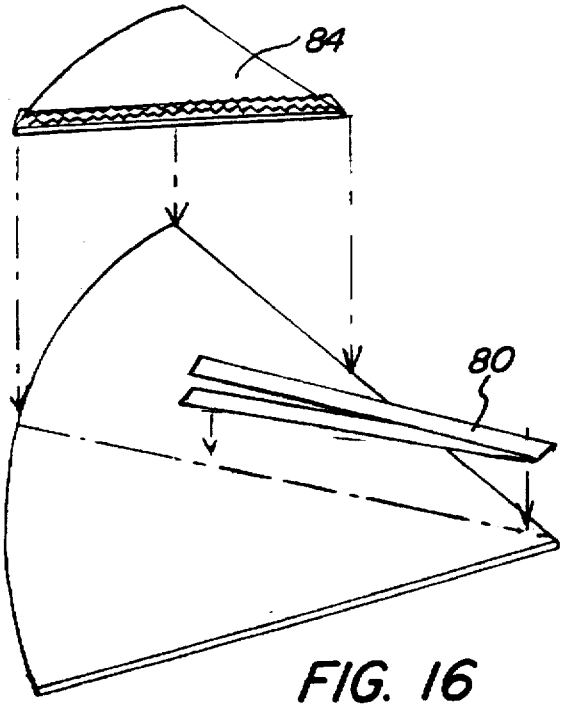
FIG. 16 shows the manner of assembly of pieces to the scrap to form a cone-shaped towel.
Figure 17:
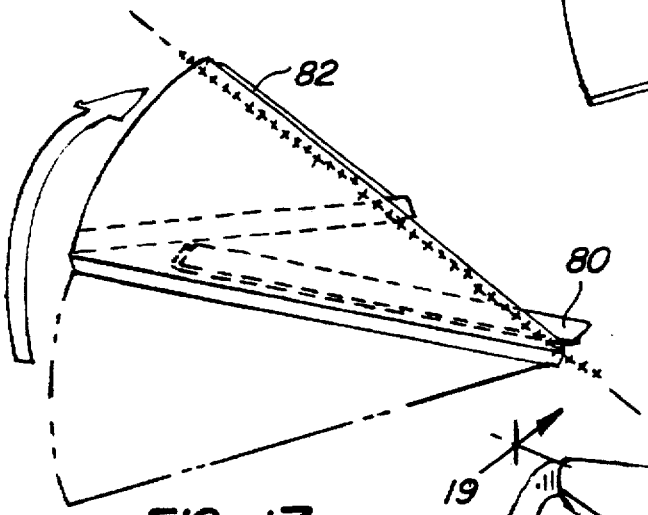
FIG. 17 is a further assembly drawing for the cone-shaped towel.
Figure 18:
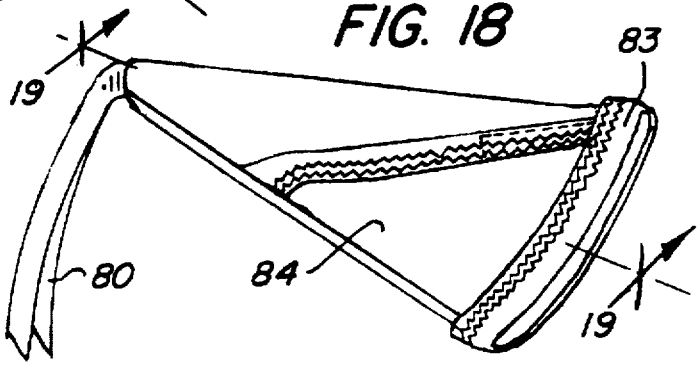
FIG. 18 is a front perspective view showing a completed cone-shaped towel.
Figure 19:
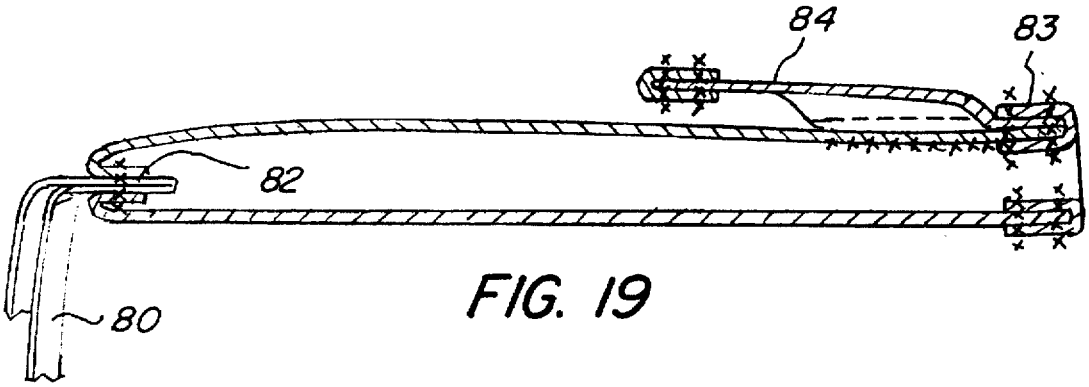
FIG. 19 is a cross-sectional view taken along line 19—19 in FIG. 18.

Referring now to FIGS. 14 through 19, the construction of a towel structure, having particular utility for cleaning golf clubs and balls due to its conical shape which easily receives the head of a golf club or a golf ball. FIG. 15 shows one piece of scrap, e.g., such as 28 from FIG. 1, preferably of terry cloth. The scrap can be from the manufacture of a single or multi layer blanket. The scrap piece 28 results from cutting at least one of the noted semicircular sections from terry cloth material to form each semicircular section. For greater economy, both of the scrap portions are utilized. Each of the two scrap portions has two straight edges (**29*a* and 29*b*) that intersect at a square corner (29*c*). The scrap portion is then cut along a radius r from the square corner 29*c* to form a rounded cut edge 29*d*. Means for forming a handle 80 is inserted between two straight edges, and the two straight edges 29*a* and 29*b* are stitched together along a seam 82. The sewn assembly is then turned inside out to form an essentially cone-shaped towel. A strip of binding material 83 is folded over and sewn to cover rounded cut edge 29*d* at a suitable stage in the procedure to give a strong finished edge. If desired, as in the preferred embodiment shown, a pocket 84** can be provided for improved utility.

Figure 20:
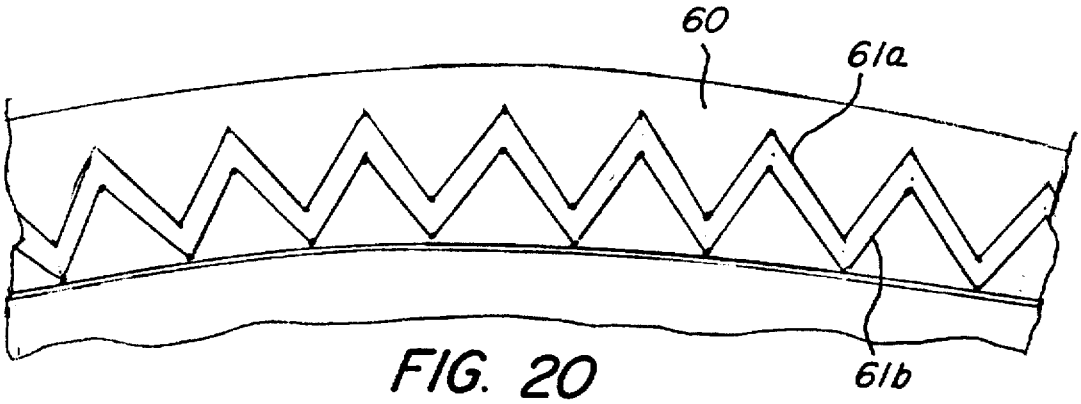
FIG. 20 is a broken away top plan view showing one edge detail.
Figure 21:
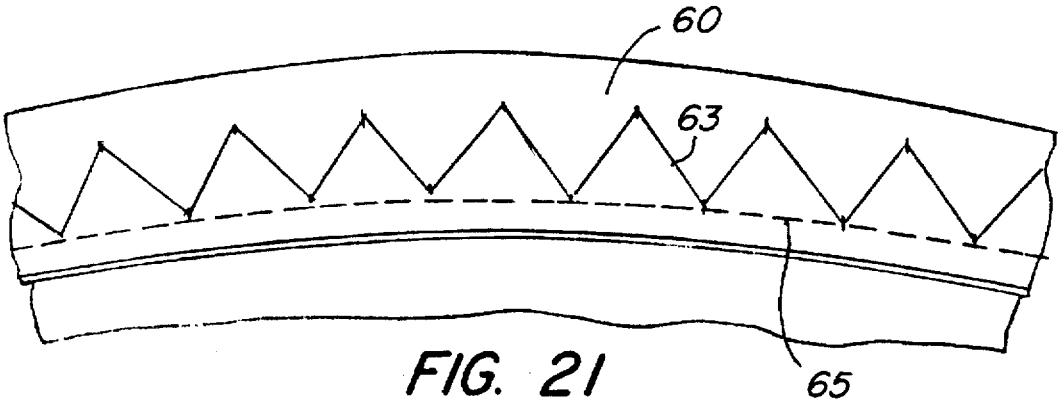
FIG. 21 is another broken away top plan view showing an alternative edge detail for a blanket structure of the invention.

The layers are held together by stitching parallel to the seams and stitching through a strip of binding material folded about the peripheral edge of the combined layers. The use of zig-zag stitches on the binding provides a rugged construction and is consistent with a design giving the impression of rays of light (e.g., sun light) radiating from the center of the blanket. FIGS. 20 and 21 provide broken away top plan views showing alternative edge details for blanket structures of the invention. The embodiment of FIG. 20 represents an industrial zig-zag stitch which provides parallel rows of stitches, **61*a* and 61*b*. FIG. 21 shows a peripheral row of straight stitches 63 bordered by a single row of zig-zag stitches 65** as done on a home sewing machine.

The above description is for the purpose of teaching the person of ordinary skill in the art how to practice the invention, and it is not intended to detail all of those obvious modifications and variations of it which will become apparent to the skilled worker upon reading the description. It is intended, however, that all such obvious modifications and variations be included within the scope of the invention which is defined by the following claims. The claims are meant to cover the claimed elements and steps in any arrangement or sequence which is effective to meet the objectives there intended, unless the context specifically indicates the contrary.

I claim:

1. A method for making a round blanket structure comprising:

providing at least four semicircular sections of material suitable for forming into a blanket;

assembling a first circular blanket layer, having a round circumferential edge and a diameter passing through its center, by joining two of said semicircular sections along a seam extending along said diameter of said first circular blanket layer;

assembling a second circular blanket layer, having a round circumferential edge and a diameter passing through its center, by joining two of said semicircular sections along a seam extending along said diameter of said second circular blanket;

assembling said first and second blanket layers with the round peripheral edges of each substantially coextensive and with said first and second diameters being nonparallel;

folding a strip of binding material to cover the coextensive peripheral edges of said first and second blanket layers;

stitching said binding to secure it to said first and second circular blanket layers and to secure both of said blanket layers into a round blanket having a unitary peripheral edge; and stitching parallel to each of said seams in said first and second blanket layers said stitching holding said layers together.

2. A method for making a round blanket structure according to the method of claim 1 which further comprises, before joining two of said sections along said seam, inserting near the center of the intended seam line means for forming a handle such that it is secured near the center of at least one of said seams in one of said circular blanket layers.

3. A method for making a round blanket structure according to the method of claim 1 which further comprises, before folding said binding material to cover the coextensive peripheral edges of said first and second blanket layers, joining a pocket formed of at least one piece of fabric extending from one of said seams to the peripheral edge of one of said layers, wherein said one piece of fabric has a top edge substantially parallel to a line transverse to said diameter of said layer and a bottom edge along said circumference.

4. A method for making a round blanket structure according to the method of claim 1 which further comprises positioning a third blanket layer between said first blanket layer and said second blanket layer.

5. A method for making a round blanket structure according to the method of claim 1 wherein the binding material is stitched around said peripheral edge with a zig-zag stitch about 50% of the width of the binding overlapping at least one of said circular blanket layers.

6. A method for making a round blanket structure according to the method of claim 1 wherein said blanket layers are stitched with parallel lines of zig-zag stitching on either side of each of said seams and said seams are transverse to said second diameter.

7. A method for making a round blanket structure according to the method of claim 1 which further comprises:

before joining two of said sections along said seam, inserting near the center of the intended seam line means for forming a handle such that it is secured near the center of at least one of said seams in one of said circular blanket layers;

before folding said binding material to cover the coextensive peripheral edges of said first and second blanket layers, joining a pocket formed of at least one piece of fabric extending from one of said seams to the peripheral edge of one of said layers, wherein said one piece of fabric has a top edge substantially parallel to a line transverse to said diameter of said layer and a bottom edge along said circumference.

8. A method for making a round blanket structure according to claim 1 which further comprises:

before joining two of said sections along said seam, inserting near the center of the intended seam line means for forming a handle such that it is secured near the center of at least one of said seams in one of said circular blanket layers;

stitching said blanket layers with parallel lines of zig-zag stitching on either side of each of said seams and said seams are transverse to said second diameter; and stitching the binding material around said peripheral edge with a zig-zag stitch about 50% of the width of the binding overlapping at least one of said circular blanket layers.

9. A method for making a round blanket structure according to claim 1 which further comprises:

cutting at least one of said semicircular sections from terry cloth material to form for each semicircular section, two scrap portions having two straight edges that intersect at a square corner;

cutting each of said scrap portions along a radius from said square corner to form a rounded cut edge;

folding a strip of binding material to cover said rounded cut edge;

inserting between said two straight edges, means for forming a handle; and joining said two straight edges by stitching them together along a seam to form an essentially cone-shaped towel.

10. A towel structure formed according to the method of claim 9.

11. A round blanket structure including at least one layer of terry cloth, comprising:

a first circular blanket layer having a round circumferential edge and a diameter passing through the center, said first circular blanket layer formed of two semicircular sections having at least one seam extending along or parallel to a first diameter of the blanket;

a second circular blanket layer overlying the first circular blanket layer and having a round circumferential edge and a diameter passing through the center, said second circular blanket layer formed of two semicircular sections having at least one seam extending along or parallel to a second diameter of the blanket, said second diameter being transverse to said first diameter;

means for forming a handle secured near the center of at least one of said seams in one of said circular blanket layers;

a strip of binding material sewn about and securing said first and second circular blanket layers into a round blanket having a unitary peripheral edge, said binding material being stitched around said peripheral edge with a zig-zag stitch at least 50% of the width of the binding overlapping at least one of said circular blanket layers;

a pocket formed of at least one piece of fabric extending from one of said seams to the peripheral edge of one of said layers, wherein said one piece of fabric has a top edge substantially parallel to a line transverse to said diameter of said layer and a bottom edge covered by said binding along said circumference, said top edge being at least partially open and said bottom edge being substantially closed; and stitching parallel to each of said seams in said first and second blanket layers said stitching extending through said first and second layers and holding said layers together, said stitching comprising parallel lines of zig-zag stitches on either side of each of said seams.

12. A round blanket structure comprising:

a first circular blanket layer having a round circumferential edge and a diameter passing through the center, said first circular blanket layer formed of two semicircular sections having at least one seam extending along or parallel to a first diameter of the blanket;

a second circular blanket layer overlying the first circular blanket layer and having a round circumferential edge and a diameter passing through the center, said second circular blanket layer formed of two semicircular sections having at least one seam extending along or parallel to a second diameter of the blanket, said second diameter being nonparallel to said first diameter;

means for forming a handle secured near the center of at least one of said seams in one of said circular blanket layers;

a strip of binding material sewn about and securing said first and second circular blanket layers into a round blanket having a unitary peripheral edge;

stitching parallel to each of said seams in said first and second blanket layers said stitching holding said layers together.

13. A round blanket structure according to claim 12 which further comprises a pocket formed of at least one piece of fabric extending from one of said seams to the peripheral edge of one of said layers, wherein said one piece of fabric has a top edge substantially parallel to a line transverse to said diameter of said layer and a bottom edge covered by said binding along said circumference, said top edge being at least partially open and said bottom edge being substantially closed.

14. A round blanket structure according to claim 12 which further comprises a third blanket layer positioned between said first blanket layer and said second blanket layer.

15. A round blanket structure according to claim 14 wherein one of said blanket layers is substantially water proof.

16. A round blanket structure according to claim 14 wherein said third blanket layer comprises a nonwoven padding material.

17. A round blanket structure according to claim 12 wherein the binding material is stitched around said peripheral edge with a zig-zag stitch about 50% of the width of the binding overlapping at least one of said circular blanket layers.

18. A round blanket structure according to claim 12 wherein said first diameter is transverse to said second diameter.

19. A round blanket structure according to claim 18 which further includes parallel lines of zig-zag stitching on either side of each of said seams extending along or parallel to said first and second diameters of the blanket.

20. A round blanket structure according to claim 12 wherein at least one of said layers comprises terry cloth.

* * * * *